US011986714B2

(12) United States Patent
Fazio

(10) Patent No.: US 11,986,714 B2
(45) Date of Patent: May 21, 2024

(54) MARTIAL ARTS TRAINING DEVICE

(71) Applicant: Raimondo Fazio, Northbridge (AU)

(72) Inventor: Raimondo Fazio, Northbridge (AU)

(73) Assignee: Raimondo Fazio, Northbridge (AU)

( * ) Notice: Subject to any disclaimer, the term of this patent is extended or adjusted under 35 U.S.C. 154(b) by 260 days.

(21) Appl. No.: 17/413,202

(22) PCT Filed: Dec. 11, 2019

(86) PCT No.: PCT/AU2019/051359
§ 371 (c)(1),
(2) Date: Jun. 11, 2021

(87) PCT Pub. No.: WO2020/118364
PCT Pub. Date: Jun. 18, 2020

(65) Prior Publication Data

US 2022/0016509 A1 Jan. 20, 2022

(30) Foreign Application Priority Data

Dec. 14, 2018 (AU) ..... 2018904753

(51) Int. Cl.
*A63B 69/22* (2006.01)
*A63B 21/02* (2006.01)
(Continued)

(52) U.S. Cl.
CPC ..... *A63B 69/22* (2022.08); *A63B 21/023* (2013.01); *A63B 71/023* (2013.01); *A63B 69/224* (2022.08);
(Continued)

(58) Field of Classification Search
CPC ..... A63B 21/023; A63B 69/22; A63B 69/20; A63B 69/34; A63B 69/222; A63B 69/224;
(Continued)

(56) References Cited

U.S. PATENT DOCUMENTS 8,337,366 B2 * 12/2012 Jones ..... A63B 24/0062 482/84
8,647,242 B2 * 2/2014 Schlicher ..... A63B 21/023 482/84
(Continued)

FOREIGN PATENT DOCUMENTS

KR 20060112549 A 11/2006
KR 20120049082 A 5/2012
WO 2009137869 A1 11/2009

OTHER PUBLICATIONS

International Search Report with Written Opinion from PCT Application No. PCT/AU2019/051359, dated Dec. 19, 2019.
(Continued)

*Primary Examiner* — Megan Anderson
(74) *Attorney, Agent, or Firm* — Workman Nydegger

(57) ABSTRACT

A martial arts training device including a support frame, a first central pad, and a second central pad. The first central pad is supported from the support frame and includes a convex surface for receiving punches and the second central pad is supported from the support frame below the first central pad and also includes a convex surface for receiving punches. The convex surface of the first central pad is tilted downwardly relative to the convex surface of the second central pad.

13 Claims, 4 Drawing Sheets

(51) Int. Cl.
*A63B 71/02* (2006.01)
*A63B 71/06* (2006.01)

(52) U.S. Cl.
CPC . *A63B 2071/0694* (2013.01); *A63B 2225/093* (2013.01); *A63B 2244/10* (2013.01); *A63B 2244/102* (2013.01)

(58) Field of Classification Search
CPC ..... A63B 69/24; A63B 71/023; A63B 2071/0694; A63B 2071/024
See application file for complete search history.

(56) References Cited

U.S. PATENT DOCUMENTS

| | | | | |
|---|---|---|---|---|
| 8,690,739 | B2 * | 4/2014 | Fazio | A63B 24/0075 482/90 |
| 9,504,893 | B2 * | 11/2016 | Nelson | A63B 69/205 |
| 11,471,739 | B2 * | 10/2022 | Wu | A63B 69/004 |
| 11,602,681 | B1 * | 3/2023 | Hammett | A63B 69/34 |
| 2009/0264262 | A1 | 10/2009 | Brenner et al. | |
| 2011/0059827 | A1 | 3/2011 | Fazio | |
| 2011/0118092 | A1 * | 5/2011 | Keary, III | A63B 69/224 482/87 |
| 2012/0214648 | A1 | 8/2012 | Schlicher | |

OTHER PUBLICATIONS

Australian Search Report from corresponding Application No. 2018904753, dated Oct. 14, 2019.

* cited by examiner

MARTIAL ARTS TRAINING DEVICE

FIELD OF THE INVENTION

The present invention relates to a device to be used for training martial arts such as boxing, kickboxing, or any other sport involving punches and/or kicks.

BACKGROUND TO THE INVENTION

A common training exercise in martial arts training involves punching or kicking pads held by a trainer. The pads are moved between different positions by the trainer so that the boxer can practise various punches.

While this type of training is useful and effective, it requires access to a trainer and therefore cannot be used if no trainer is available. Also, in a gym where trainers may be available, only a limited number of participants can use this type of training at any one time.

Further, trainers providing this type of training are often exposed to repetitive stresses associated with using punch pads of this type. Holding pads up and taking the impact of the punches places stresses on the arm joints of the trainer which, in the long term, can cause significant injuries. While exercise devices exist that do allow a person to practice on fixed punching pads, such as bags or padded body-shaped apparatus, these devices do not replicate particularly well the exercises conducted by a trainer holding pads.

A range of devices for training martial arts have been developed in view of the abovementioned issues. The applicant's own earlier International patent, publication number WO2009/137869, address these issues by creating a useful alternative to training with a trainer. This device provides a particular configuration useful for boxing training.

The present invention relates to a further device which is designed to provide this type of training but to also provide a configuration design to allow kicking of the pads, along with punching. Various such training devices have previously been designed to allow both punching and kicking. One issue with such devices is that it is common for the person using the device to need to regularly shift positions when changing between a range of punches and kicks.

The present invention relates to a training device aimed at addressing the above issues and providing a configuration which makes the device particularly suitable for punching and kicking in a manner which is natural and allows easy transition between various punch and kick combinations.

SUMMARY OF THE INVENTION

According to one aspect of the present invention there is provided a martial arts training device comprising:

a support frame;

a first central pad supported from the support frame, the first central pad including a convex surface for receiving punches; and a second central pad supported from the support frame below the first central pad, the second central pad including a convex surface for receiving punches;

wherein the convex surface of the first central pad is tilted downwardly relative to the convex surface of the second central pad.

Preferably the convex surfaces of the first and second central pads are semi-cylindrical in shape such that a longitudinal axis of the convex surface of the second central pad is oriented vertically and a longitudinal axis of the convex surface of the first central pad is further away from the post adjacent an upper end of the post than adjacent a lower end of the post.

In a preferred embodiment, a third central pad is supported from the frame above the first central pad, the third central pad including a convex surface for receiving punches.

Preferably the convex surface of the third central pad is semi-cylindrical in shape such that a longitudinal axis of the convex surface of the third central pad is oriented vertically.

Preferably first and second side pads are provided, each of the side pads comprising elongate pads mounted to extend vertically along opposed vertical sides of the first second and third central pads.

Preferably each of the first and second side pads is cylindrical in shape and is mounted relative to the frame such that upper ends of the first and second side pads are located adjacent an upper end of the third central pad and lower ends of the first and second side pads are located adjacent a lower end of the second central pad.

Preferably the first and second side pads are angled relative to the vertical such that upper ends thereof are further apart than lower ends thereof.

In a preferred embodiment, the first and second side pads are mounted to mounting plates provided on elongate members supported from the support frame.

Preferably upper ends of the elongate members are supported from the support frame by upper arms and lower ends of the elongate members are supported by lower arms, each of the upper and lower arms including spring members therein.

In a preferred embodiment, the support frame comprises a post having a sleeve mounted for sliding motion relative to the post and wherein the central pads and side pads are mounted to the sleeve.

Preferably the central pads and side pads are resiliently mounted relative to the sleeve.

Preferably spring members are provided extending between one or more of the central pads and side pads and the sleeve.

Preferably a lower pad is provided, the lower pad comprising a cylindrical pad having an upper end located adjacent a lower end of the second central pad and a lower end located adjacent the floor.

Preferably the lower pad is angled such that the lower end thereof is located further from the post than the upper end thereof.

Preferably the lower pad is supported by a support member comprises an elongate member having an upper portion and a lower portion, the upper portion extending forwardly and downwardly from the sleeve and the lower portion extending vertically downwardly from the second end of the upper portion.

Preferably the lower portion of the support member is received for sliding motion within a bracket supported forwardly of the post by a mounting frame.

Preferably the mounting frame extends outwardly from the post and includes a spring member extending outwardly therefrom and the bracket comprises a ring through which the lower portion of the support member is received.

BRIEF DESCRIPTION OF THE DRAWINGS

The invention will now be described, by way of example, with reference to the following drawings, in which.

DETAILED DESCRIPTION OF PREFERRED EMBODIMENTS

Figure 1:
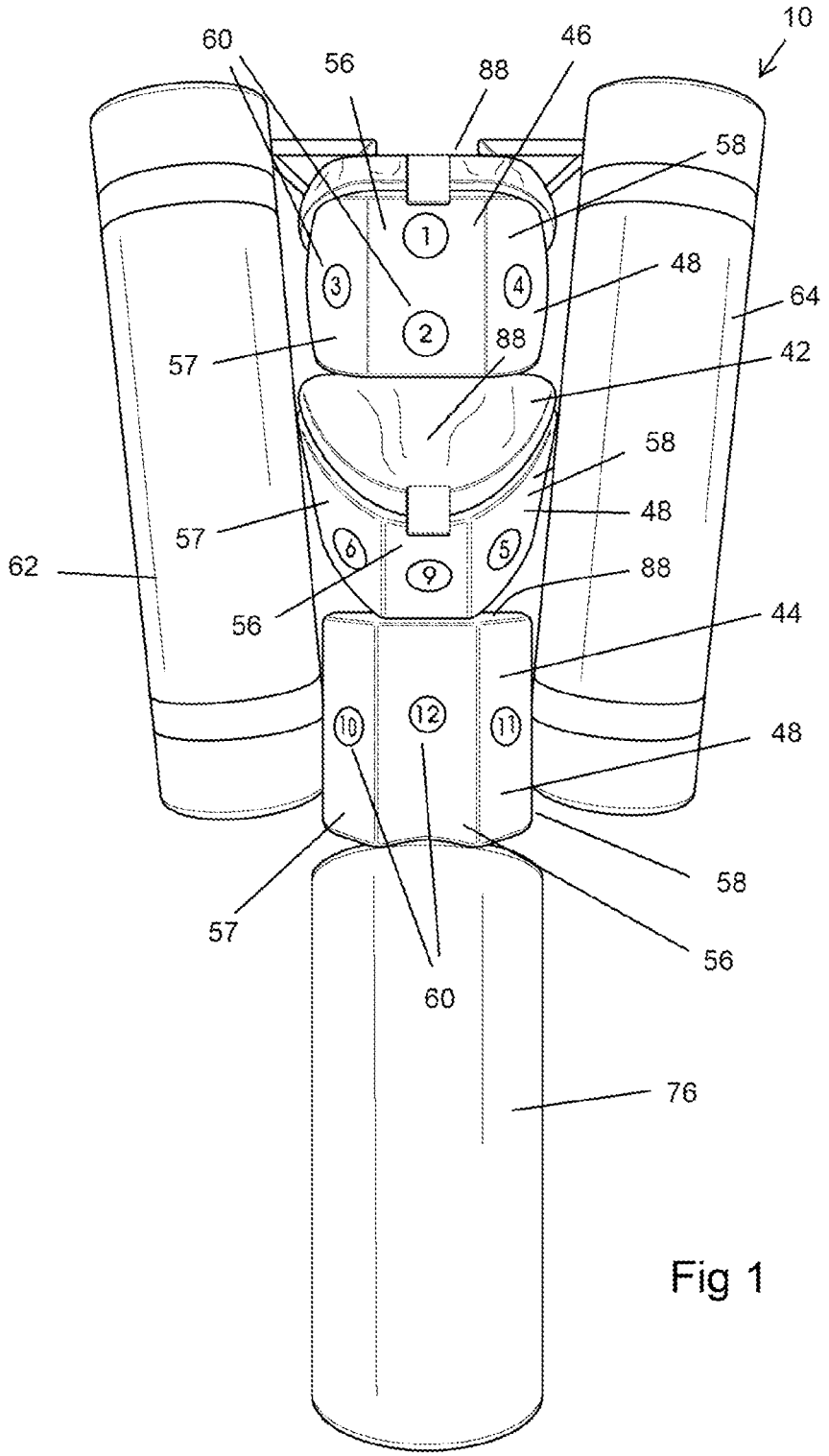
FIG. 1 is a front view of a martial arts training device in accordance with the present invention.
Figure 2:
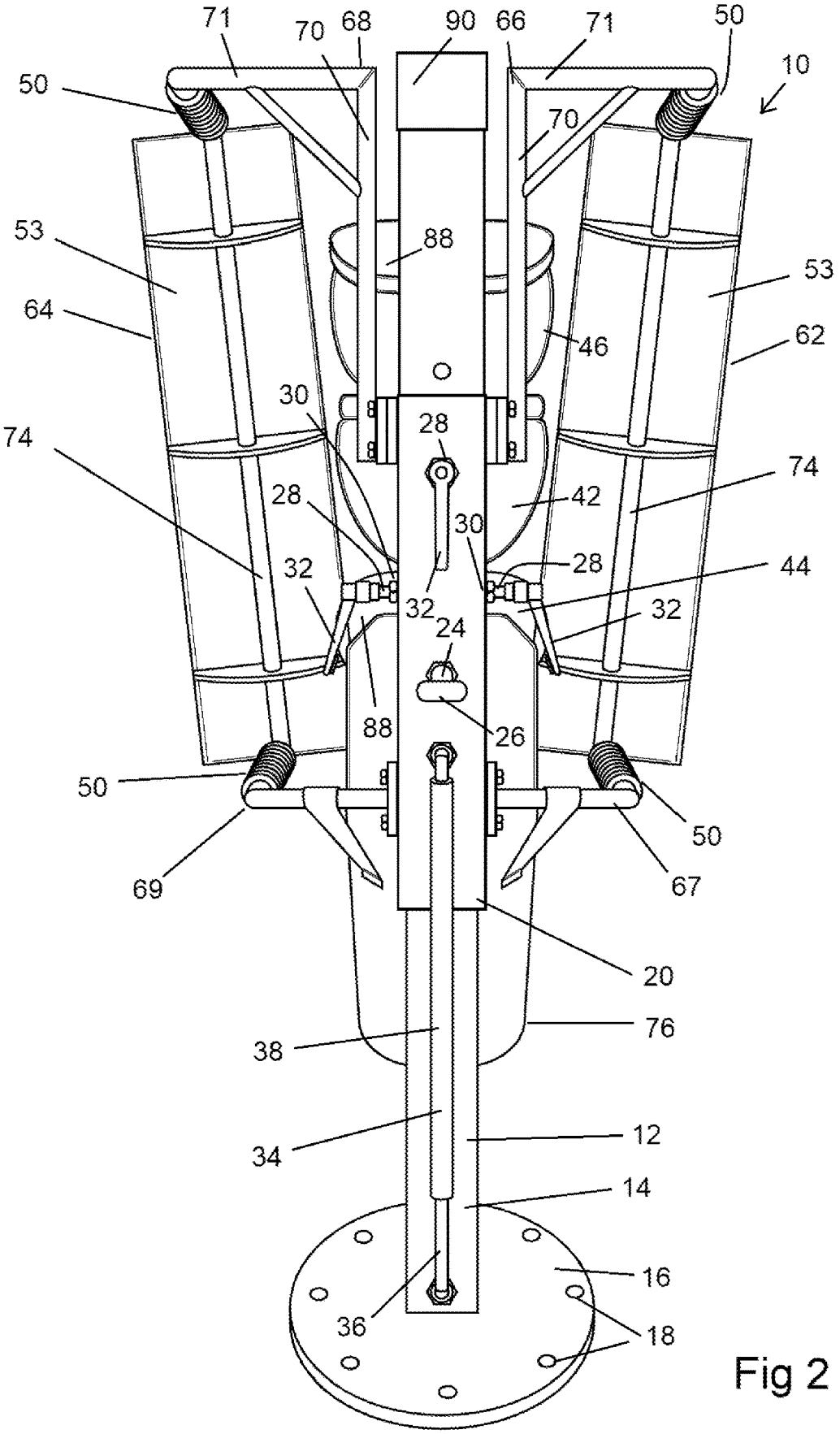
FIG. 2 is a rear view of the martial arts training device of FIG. 1.
Figure 3:
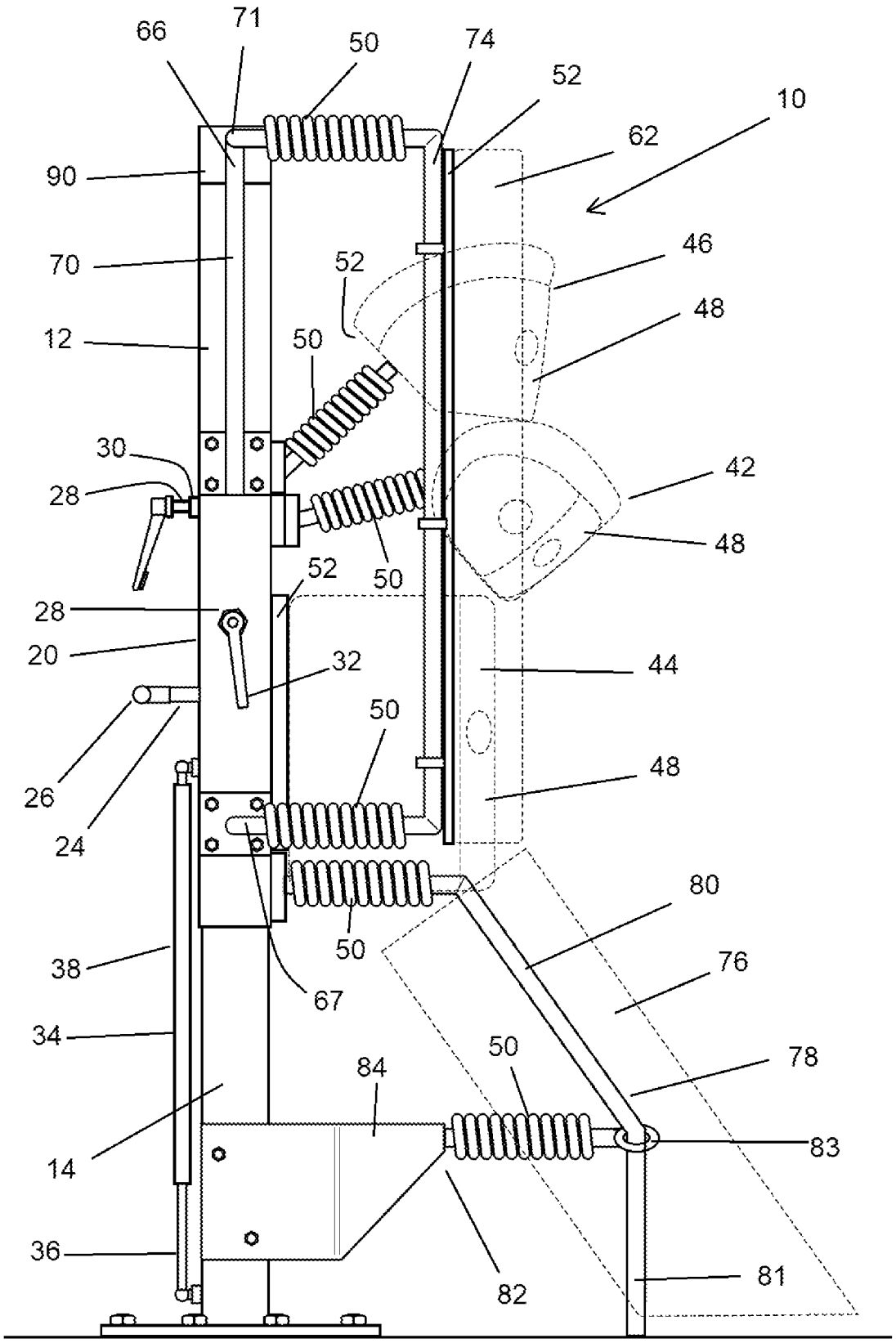
FIG. 3 is a side view of the martial arts training device of FIG. 1.

Referring to the Figures, there is shown a martial arts training device 10 comprising generally a support frame 12 and a plurality of pads. In the embodiment shown, the support frame 12 comprises a post 14. The post 14 is provided with a base plate 16 secured to a lower end thereof. The base plate 16 is provided with a plurality of holes 18 such that the base plate 16 may be fixed to the floor by suitable fasteners inserted through the holes 18 and into the floor.

The pads of the martial arts training device 10 are secured to the post 14 such that the pads are height adjustable relative to the post 14. In the embodiment shown, the post 14 is provided with a sleeve 20 through which the post 14 is received such that the sleeve 20 may slide up and down along a portion of the length of the post 14. In the embodiment shown, the post 14 is rectangular in transverse cross section and the sleeve 20 comprises a tubular elongate member having a corresponding rectangular transverse cross section to receive the post 14.

The sleeve 20 may be fixed relative to the post 14 by one or more securing members such that the sleeve 20 may be secured in a plurality of positions relative to the post 14. In the embodiment shown, the securing members include a spring biased pin 24 passing through an aperture in a rear side of the sleeve 20. The pin 24 is spring biased such that the pin 24 tends to move inwardly towards the post 14. The pin 24 includes a handle portion 26 on an outer end thereof such that the pin 24 may be pulled outwardly by the handle portion 26 against the force of the spring. An inner end of the pin 24 may be received within one of a plurality of corresponding apertures provided in a rear surface of the post 14 to secure the sleeve 20 relative to the post 14.

The securing members may also comprise locking members 28 comprising a threaded member received within a collar 30 having an internal thread and extending outwardly from a rear surface of the sleeve 20. The locking member 28 may be rotated to move an inner end of the locking member 28 towards or away from the rear surface of the post 14. The locking member 28 may therefore be tightened to engage against the rear surface of the post 14 to fix the sleeve 20 from any movement relative to the post 14. Each of the locking members 28 includes a handle 32 on an outer end thereof to allow rotation of the locking member 28.

The sleeve 20 is provided also with a support strut 34 connecting between the sleeve 20 and a lower end of the post 14. The support strut 34 comprises a piston 36 received within a cylinder 38 such that the support strut 34 supports a portion of the weight of the sleeve 20. The support strut 34 thereby assists the process of sliding the sleeve 20 upwardly or downwardly relative to the post 14. The post 14 is provided with a cap 90 on the upper end thereof. The cap 90 is provided to limit upper travel of the sleeve 20 relative to the post 14.

The martial arts training device 10 includes a plurality of central pads supported generally in front of the post 14. There is provided in the embodiment shown a first central pad 42, a second central pad 44 a third central pad 46. The first central pad 42 is supported forwardly of the post 14 with the second central pad 44 located below the first central pad 42 and the third central pad 46 located above the first central pad 42.

Each of the first, second and third central pads 42, 44 and 46 is provided with a convex surface 48 facing generally away from the post 14 which may be struck with punches during use. The convex surfaces 48 of the central pads 42, 44 and 46 are generally semi-cylindrical in shape with a central area thereof being located on the side of the central pad 42, 44, 46 directed away from the post 14.

The central pads 42, 44 and 46 are formed from a suitable resilient material, such as a foam material, having an outer sheet material cover in order to absorb the impact of punches delivered to the central pads 42, 44 and 46. One or more of the central pads 42, 44 and 46 are preferably resiliently mounted to the post 14. In the embodiment shown, the first and third central pads 42 and 46 are connects to the post by spring members 50. The spring members 50 comprise elongate coil springs having first ends secured to the sleeve 20 and second ends each secured to a central backing plate 52 to which the central pads 42 and 46 are mounted. The spring members 50 are formed from a metallic material of sufficient strength to withstand the repeated impacts which would be expected during use. In the embodiment shown, the second central pad 42 is mounted to a central backing plate 52 which is secured directly to the sleeve 20 below first ends of the spring members 50.

The outer convex surfaces 48 of the second and third central pads 44 and 46 are oriented such that the central areas thereof are generally vertical in use. That is, the semi cylindrical shape of the convex surfaces 48 of the second and third central pads 44 and 44 have longitudinal axes thereof which are generally vertical in use. The convex surface 48 of the first central pad 42 however is tilted such that an upper end thereof is located closer to a person standing in front of the martial arts training device 10 then a lower end thereof. That is, the semi cylindrical shape of the convex surface 48 of the first central pad 42 has a longitudinal axis tilted such that said longitudinal axis is further away from the post 14 adjacent an upper end of the post 14 than adjacent a lower end of the post 14.

The convex surfaces 48 of the first, second and third central pads 42, 44 and 46 may be defined by a plurality of planar surfaces. In the embodiment shown, each of the central pads 42, 44 and 46 is provided with a central planar surface 56 and first and second side planar surfaces 57 and 58. The central planar surfaces 56 are located centrally on the convex surfaces 48 of the central pads 42, 44 and 46 and are generally rectangular in the embodiment shown. The first and second side planar surfaces 57 and 58 extend either side of the central planar surfaces 56 at angles thereto and also comprise generally rectangular areas in the embodiment shown.

Each of the central and first and second side planar surfaces 56, 57 and 58 the central pads 42, 44 and 46 may be provided with a marking on a surface thereof. In the embodiment shown, the markings comprise numerical markings 60 such that each surface portion 56, 57, 58 is provided with a unique number. The numbers may be used for instructional purposes when directing a person using the martial arts training device 10 to perform a series of directed punches to specific areas of central pads 42, 44 and 46.

Each of the first, second and third central pads 42, 44 and 46 includes an upper surface 88. The upper surfaces 88 are generally planar. Due to the arrangement of the first, second and third central pads 42, 44 and 46, the upper surfaces 88 of the second and third central pads 44 and 46 are generally horizontal in use. The upper surface 88 of the first central pad 42 is angled downwardly such that a forward edge thereof is lower than a rear edge thereof.

The martial arts training device 10 is provided also with first and second side pads 62 and 64. Each of the side pads 62 and 64 is mounted relative to the post 14 to extend vertically along a vertical side of the first, second and third central pads 42, 44 and 46.

The first side pad 62 is supported by first upper and lower arms 66 and 67. The first upper arm 66 is secured to the sleeve 20 adjacent an upper end on a first side thereof. The first lower arm 66 is secured to the sleeve 20 adjacent a lower end on the first side thereof. The first upper arm 66 includes a first portion 70 comprising an elongate member extending upwardly adjacent the post 14 on a first side thereof and a second portion 71 comprising an elongate member extending away from the post 14 on the first side thereof. The first lower arm 67 comprises an elongate member extending directly away from the first side of the post 14.

The first upper and lower arms 66 and 67 include spring members 50 extending outwardly therefrom forwardly relative to the post 14. The first side pad 62 is secured to an elongate member 74 extending from a distal end of the spring member 50 of the first lower arm 67 to a distal end of the spring member 50 of the first upper arm 66. The elongate member 74 includes a side backing plate 53 secured thereto to receive the first side pad 62. The first side pad 62 is semi-cylindrical in shape and is arranged such that an upper end thereof is adjacent an upper end of the third central pad 46 and a lower end thereof is adjacent a lower end of the second central pad 44.

The second side pad 64 is supported by second upper and lower arms 68 and 69. The second upper arm 68 is secured to the sleeve 20 adjacent an upper end on a second side thereof. The second lower arm 68 is secured to the sleeve 20 adjacent a lower end on the second side thereof. The second upper arm 68 includes a first portion 70 comprising an elongate member extending upwardly adjacent the post 14 on a second side thereof and a second portion 71 comprising an elongate member extending away from the post 14 on the second side thereof. The second lower arm 69 comprises an elongate member extending directly away from the second side of the post 14.

The second upper and lower arms 68 and 69 include spring members 50 extending outwardly therefrom forwardly relative to the post 14. The second side pad 64 is secured to an elongate member 74 extending from a distal end of the spring member 50 of the second lower arm 69 to a distal end of the spring member 50 of the second upper arm 68. The elongate member 74 includes a side backing plate 53 secured thereto to receive the second side pad 64. The second side pad 64 is semi-cylindrical in shape and is arranged such that an upper end thereof is adjacent an upper end of the third central pad 46 and a lower end thereof is adjacent a lower end of the second central pad 44.

The elongate members 74 supporting the first and second side pads 62 and 64 are angled such that upper ends of the elongate members 74 are further apart than lower ends thereof. The first and second side pads 62 and 64 are therefore tilted slightly from the vertical such that upper ends thereof are further apart than lower ends thereof in order to better receive kicks. The side pads 62 may also be used for punching.

The martial arts training device 10 includes also a lower pad 76. The lower pad 76 is cylindrical in shape and includes an upper end adjacent a lower side of the second central pad 44. A lower end of the lower pad 76 is located generally adjacent the floor in use. A longitudinal axis of the lower pad 76 is tilted relative to the post 14 such that the lower end of the lower pad 76 is located further from the post 14 than the upper end thereof.

The lower pad 76 is supported by a support member 78. The support member 78 comprises an elongate member having an upper portion 80 and a lower portion 81. The upper portion 80 has a first end secured to the sleeve 20 adjacent a lower end thereof. The first end of the upper portion 80 is supported forwardly of the sleeve 20 by a spring member 50 extending directly outwardly from the sleeve 20. The upper portion 80 extends forwardly and downwardly from the outer end of the spring member 50. The lower portion 81 extends from the second end of the upper portion 80 downwardly such that the lower portion 81 is generally vertical in use.

The lower portion 81 of the support member 78 is received within a bracket 82 supported forwardly of the post 14 by a mounting frame 84. The mounting frame 84 extends outwardly from the post 14 and includes a spring member 50 extending outwardly therefrom. The bracket 82 is secured to a distal end of the spring member 50 and comprises a ring 83 through which the lower portion 81 of the support member 78 is received. The support member 78 may therefore move upwardly and downwardly with movement of the sleeve 20 by sliding motion of the lower portion 81 within the ring 83.

The lower pad 76 includes a longitudinal slit therein such that the slit may receive the support member 78. Securing means, such as Velcro straps or tabs, may be engaged across the slit to secure the lower pad 76 relative to the support member 78.

In use, the martial arts training device 10 may be used by a person standing in front of the central pads 42, 44 and 46. The user may direct various combinations of punches towards the first, second and third central pads 42, 44 and 46. Right-hand blows would generally be directed towards the right sides of the first, second and third central pads 42, 44 and 46 and left-hand blows would be directed towards the left sides of the first, second and third central pad 42, 44 and 46. Either right or left hand blows may be directed towards the central portions of the first, second and third central pads 42, 44 and 46. The first and second side pads 62 and 64 may be used for kicks of the type that would be directed towards the body of an opponent. The side pads 62 and 64 may also be used for punching. The lower pad 76 may be used for kicks which would be directed towards the legs of an opponent.

The first central pad 42 would generally be used for straight punches and hooks. The second central pad 44 would generally be used for body rips, straights and push kicks and the third central pad would generally be used for uppercuts and hooks. The first central pad 42 represents in use a head of an opponent ducking and the third central pad represents the head of an opponent standing.

The arrangement of the various pads of the martial arts training device 10 allows a range of punch and kick combinations with the pads being located such that these combinations may be delivered in a natural fashion with limited variation of the body position of the person using the device.

Figure 4B:
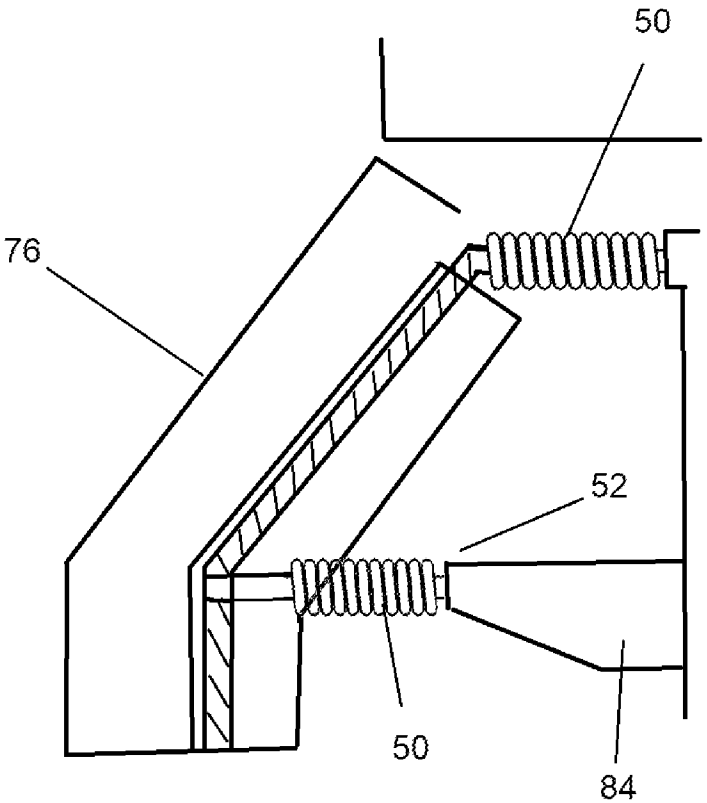
FIG. 4*b* is a side view of the lower pad of FIG. 4*a*.
Figure 4A:
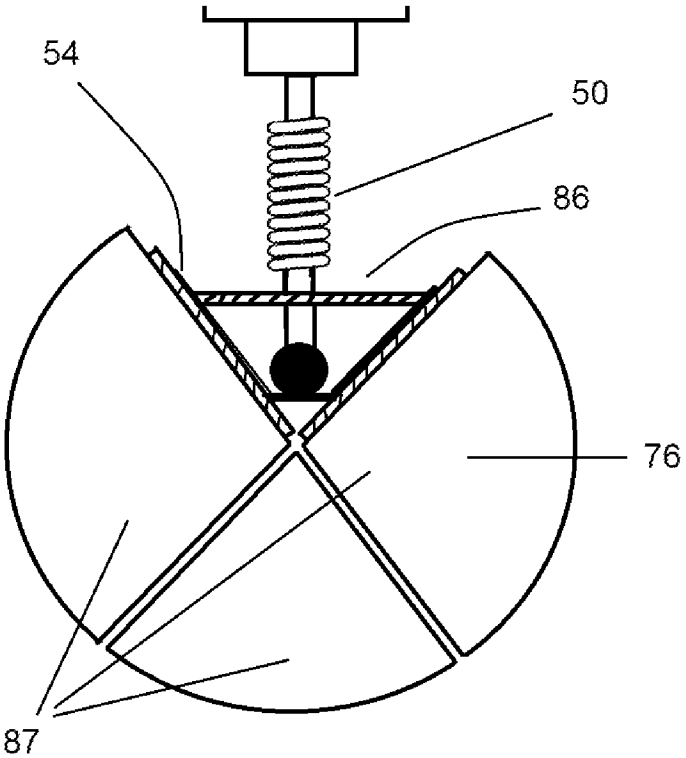
FIG. 4*a* is a top view of a second embodiment of a lower pad of the martial arts training device.

FIG. 4 shows an alternative embodiment for mounting the lower pad 76 of the martial arts training device 10. In this embodiment, the lower pad is mounted to a lower backing plate 54 which comprises a plate bent to have a V-shaped transverse cross section. The lower backing plate 54 is mounted to the support member 78. The lower pad 76 includes a wedge-shaped recess in a rear side thereof to receive the lower backing plate 54. The lower pad 76 may also be provided as a plurality of wedge-shaped segments 87 connected together to form the lower pad 76 (as can be seen in FIG. 4*a*).

It will be readily apparent to persons skilled in the relevant arts that various modifications and improvements may be made to the foregoing embodiments, in addition to those already described, without departing from the basic inventive concepts of the present invention.

The invention claimed is:

1. A martial arts training device comprising:

a support frame;

a first central pad supported from the support frame, the first central pad including a convex surface for receiving punches; and a second central pad supported from the support frame below the first central pad, the second central pad including a convex surface for receiving punches, wherein the convex surface of the first central pad is tilted downwardly relative to the convex surface of the second central pad, wherein a third central pad is supported from the frame above the first central pad, the third central pad including a convex surface for receiving punches, wherein the convex surface of the third central pad is semi-cylindrical in shape such that a longitudinal axis of the convex surface of the third central pad is oriented vertically, wherein first and second side pads are provided, each of the first and second side pads comprising elongate pads mounted to extend vertically along opposed vertical sides of the first second and third central pads, and wherein each of the first and second side pads is cylindrical in shape and is mounted relative to the frame such that upper ends of the first and second side pads are located adjacent an upper end of the third central pad and lower ends of the first and second side pads are located adjacent a lower end of the second central pad.

2. The martial arts training device in accordance with claim 1, wherein the support frame comprises a post having a sleeve mounted for sliding motion relative to the post and wherein the first and second central pads and first and second side pads are mounted to the sleeve.

3. The martial arts training device in accordance with claim 2, wherein the first and second central pads and the first and second side pads are resiliently mounted relative to the sleeve.

4. The martial arts training device in accordance with claim 3, wherein spring members are provided extending between one or more of the first and second central pad and the first and second side pads and the sleeve.

5. The martial arts training device in accordance with claim 1, wherein the support frame comprises a post, and wherein the convex surfaces of the first and second central pads are semi-cylindrical in shape such that a longitudinal axis of the convex surface of the second central pad is oriented vertically and a longitudinal axis of the convex surface of the first central pad is further away from the post adjacent an upper end of the post than adjacent a lower end of the post.

6. The martial arts training device in accordance with claim 1, wherein the first and second side pads are angled relative to the vertical such that upper ends thereof are further apart than lower ends thereof.

7. The martial arts training device in accordance with claim 1, wherein the first and second side pads are mounted to mounting plates provided on elongate members supported from the support frame.

8. The martial arts training device in accordance with claim 1, wherein a lower pad is provided, the lower pad comprising a cylindrical pad having an upper end located adjacent a lower end of the second central pad and a lower end located adjacent the floor.

9. A martial arts training device comprising:

a support frame;

a first central pad supported from the support frame, the first central pad including a convex surface for receiving punches; and a second central pad supported from the support frame below the first central pad, the second central pad including a convex surface for receiving punches, wherein the convex surface of the first central pad is tilted downwardly relative to the convex surface of the second central pad, wherein a third central pad is supported from the frame above the first central pad, the third central pad including a convex surface for receiving punches, wherein the convex surface of the third central pad is semi-cylindrical in shape such that a longitudinal axis of the convex surface of the third central pad is oriented vertically, wherein first and second side pads are provided, each of the first and second side pads comprising elongate pads mounted to extend vertically along opposed vertical sides of the first second and third central pads, wherein the first and second side pads are mounted to mounting plates provided on elongate members supported from the support frame, and wherein upper ends of the elongate members are supported from the support frame by upper arms and lower ends of the elongate members are supported by lower arms, each of the upper and lower arms including spring members therein.

10. A martial arts training device comprising:

a support frame;

a first central pad supported from the support frame, the first central pad including a convex surface for receiving punches; and a second central pad supported from the support frame below the first central pad, the second central pad including a convex surface for receiving punches, wherein the convex surface of the first central pad is tilted downwardly relative to the convex surface of the second central pad, wherein a lower pad is provided, the lower pad comprising a cylindrical pad having an upper end located adjacent a lower end of the second central pad and a lower end located adjacent the floor, and wherein the support frame comprises a post, and wherein the lower pad is angled such that the lower end thereof is located further from the post than the upper end thereof.

11. The martial arts training device in accordance with claim 10, wherein the lower pad is supported by a support member comprises an elongate member having an upper portion and a lower portion, the upper portion extending forwardly and downwardly from the sleeve and the lower portion extending vertically downwardly from the second end of the upper portion.

12. The martial arts training device in accordance with claim 11, wherein the lower portion of the support member is received for sliding motion within a bracket supported forwardly of the post by a mounting frame.

13. The martial arts training device in accordance with claim 12, wherein the mounting frame extends outwardly from the post and includes a spring member extending outwardly therefrom and the bracket comprises a ring through which the lower portion of the support member is received.

* * * * *